United States Patent [19]

Fischer et al.

[11] 4,208,697

[45] Jun. 17, 1980

[54] APPARATUS FOR CHARGING PHOTO-ELECTROSTATIC SEMICONDUCTOR LAYERS

[76] Inventors: Henning Fischer, No. 18, Beymestrasse, 1000 Berlin 41; Günter Leverentz, No. 12, Sanderstrasse, 1000 Berlin 44, both of Fed. Rep. of Germany

[21] Appl. No.: 826,103

[22] Filed: Aug. 19, 1977

[30] Foreign Application Priority Data

Aug. 30, 1976 [DE] Fed. Rep. of Germany ..... 2639525

[51] Int. Cl.[2] ..... G03G 13/00; G03G 15/00

[52] U.S. Cl. ..... 361/229; 250/324; 355/3 CH

[58] Field of Search ..... 361/229, 230; 250/324, 250/325, 326; 355/3 CH

[56] References Cited

U.S. PATENT DOCUMENTS

| | | | |
|---|---|---|---|
| 3,558,307 | 1/1971 | Carlson | 250/325 |
| 3,744,898 | 7/1973 | Kurahashi et al. | 250/325 |
| 3,769,506 | 10/1973 | Silverberg | 361/229 |
| 3,811,048 | 5/1974 | Matsumoto et al. | 361/230 |
| 3,937,960 | 2/1976 | Matsumoto et al. | 361/230 |
| 3,967,118 | 6/1976 | Sternberg | 250/325 |
| 3,967,119 | 6/1976 | Matsumoto | 361/229 |

FOREIGN PATENT DOCUMENTS

| | | | |
|---|---|---|---|
| 1497132 | 4/1969 | Fed. Rep. of Germany | 361/229 |
| 2134698 | 1/1973 | Fed. Rep. of Germany | 361/229 |
| 7404433 | 9/1975 | Fed. Rep. of Germany | 355/3 CH |
| 826088 | 12/1959 | United Kingdom | 361/229 |

*Primary Examiner*—J. D. Miller
*Assistant Examiner*—L. C. Schroeder
*Attorney, Agent, or Firm*—John C. Smith, Jr.

[57] ABSTRACT

An apparatus for the rated charging of electrostatic layers after exposure by a corona discharge is provided, in which the primary current of the voltage transformer and/or the resistance between the corona tube and earth (housing) is varied and which comprises means for altering the position and/or the spacing of the electrode relative to the electrostatic layer.

20 Claims, 11 Drawing Figures

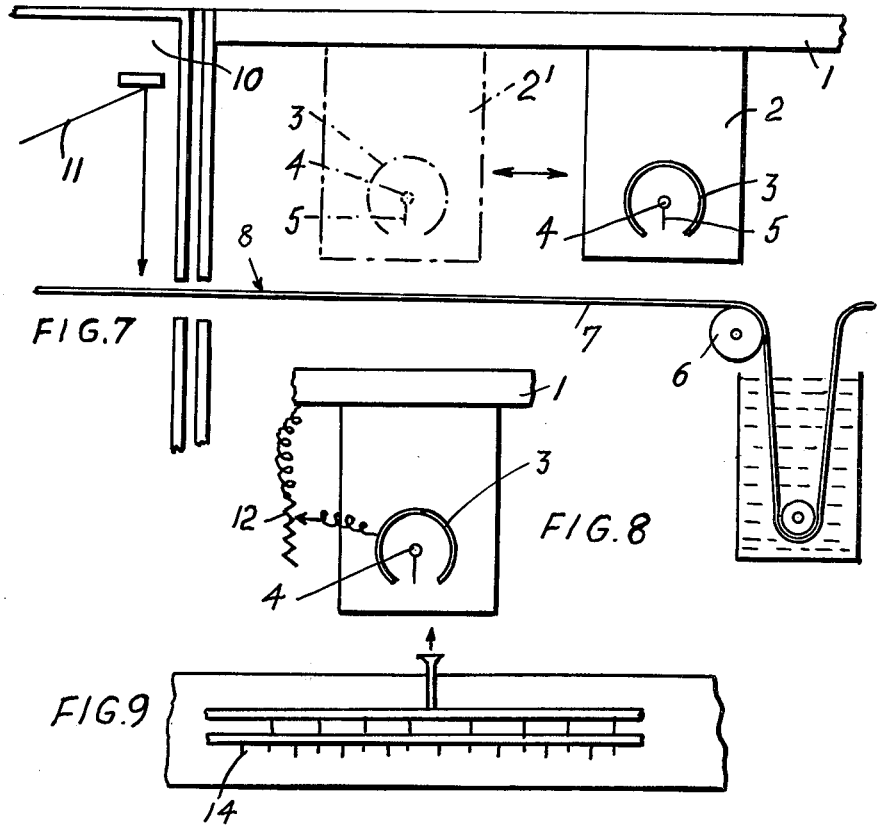
FIG.7
FIG.8
FIG.9
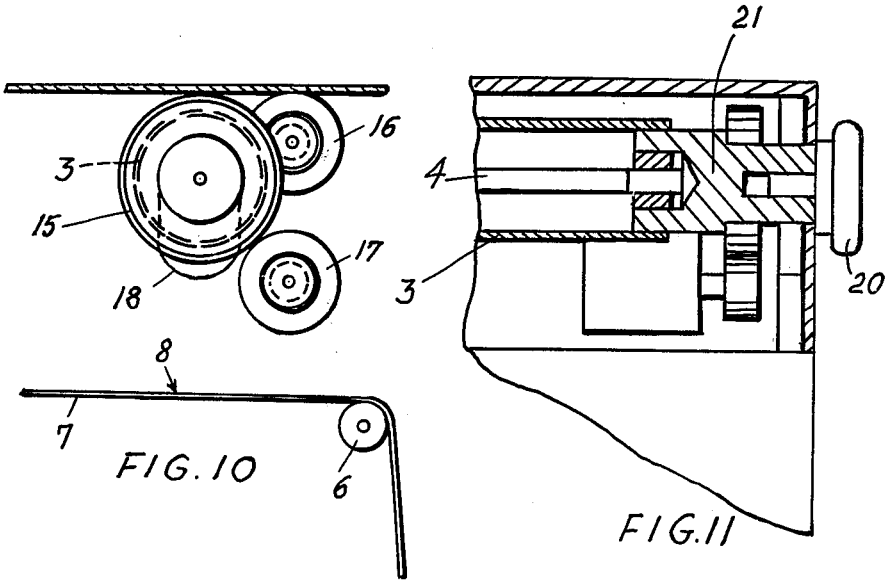
FIG.10
FIG.11

APPARATUS FOR CHARGING PHOTO-ELECTROSTATIC SEMICONDUCTOR LAYERS

BACKGROUND OF THE INVENTION

This invention relates to an apparatus for the electrostatic charging of photo-conductive semiconductor layers, in particular photo-electrostatic zinc oxide layers. Specifically, the invention is intended for use according to the so-called Corton method as discussed in German Utility Model Application No. G 7,404,433 published Sept. 11, 1975.

This Corton principle which is possible with specific photo-conductive semiconductor layers which are able to store the image information for a sufficient period of time prior to charging has advantages for numerous reasons over the conventional method in which the exposure is effected after charging. The advantages of an exposure prior to charging are mainly provided by the substantially more stable latent conduction image which is produced after exposure as compared with the latent charge image which is present after charging and exposure. The latter should be produced only shortly prior to development (toning).

The Corton method also has the advantages to conduct exposure independent of the charging and development. So for instance the production of the latent conduction image may be effected substantially quicker or slower than the charging or development. In the registering field for instance paper velocities of up to 6 m/sec occur at which a latent conduction image may be produced. The production of the latent conduction image therefrom would only be possible with very high expense at this speed. Via a buffer cassette, this exposure may be made visible with a few seconds delay in using a Corton apparatus.

No further statements are here to be made on the production and the structure of the latent conduction images. It is stated for an understanding of the apparatus according to the invention, however, that the structure of the conduction image is dependent on numerous factors such as exposure time and intensity and effects which are effective prior to, during and after exposure (e.g. stray light, heat etc.).

It has been ascertained that the quality of the developed image, i.e. rendering visible the conduction image composed so differentiatedly, to a high degree depends on the nature of conversion into a corresponding charge image. In other words, this means that according to the Corton principle very precisely neither too much nor too little charge is to be applied to the exposed photo-conductive semiconductor layer. Too much charge would partially or entirely extinguish the latent conduction image again. Too little charge would result in too less a potential difference between exposed (conductive) and nonexposed (insulating) spots, and this has as a result a too weak blackening of the exposed spots by a reversal toner.

Contrary thereto it was not so important with the conventional method of charging prior to exposure for the quality of the developed image whether the layer was overcharged or not prior to exposure.

SUMMARY OF THE INVENTION

An object of the invention is to develop a method and an apparatus which are able to convert the latent conduction image into a developable charge image as free of losses as possible.

It is known for the conventional method to control the charging of electrostatic layers by shielding or intermediate grids with or without an applied potential, but these measures did not bring about the desired success for the Corton principle without a very high expense.

It is furthermore known to vary charging by varying the corona current, for instance via a potentiometer at the input of the voltage transformer. This is not successfully to be done in the ratio, however, which the very greatly varying paper speeds of 1 mm/min to 6 m/sec require.

It has now been found that next to an electronic fine control a mechanical alteration of the corona offers the best possibility of ratedly charging the differentiatedly structured conduction image. The solution of the problem of coverting the latent conduction image as free of destruction as possible into an equally differentiated charge image has been described in the invention set forth in the claims. By individual ones or also be an interlinking of a plurality of these measures, charge images may successfully be produced which in the subsequent toning render visible the conduction images produced under most varying conditions.

A further requirement of practice is an automatic variation of the corona charging depending on the paper speed. Via a tachogenerator at the paper transport motor, the primary current at the high-voltage transformer may be controlled by means of a suitable potentiometer.

In order to now also vary this primary current further depending on the various corona positions, additional potentiometers must vary the corona current accordingly upon a rotation of the corona tube, namely in a different rating for a varied spacing of the corona tube relative to the paper.

In order to always keep the relative position of the potentiometer to the rotary position of the corona tube reproducible, suitable measures should be taken, e.g.: (a) upon adjustment of the spacing of the corona tube the now no longer used potentiometer may be returned into the zero position by a spring or by other measures; (b) when the height adjustability of the corona tube is permitted only in a predetermined rotary position, e.g. perpendicular, the relatively same potentiometer position relative to the rotary position of the corona tube is always achieved.

Thus, by this measure latent conduction images which have been produced at paper speeds of 1 to 1.000 mm/sec and by exposure times of between 1 and $10^{-5}$ sec may be charged and toned in the same Corton apparatus.

BRIEF DESCRIPTION OF THE DRAWINGS

Preferred embodiments of the invention will now be described by way of example and with reference to the accompanying drawings, in which:

FIG. 7 is a schematic illustration of a displaceable retainer of the corona tube;

FIG. 8 is a similar view of a corona current amplification;

FIG. 9 illustrates a variation of the loading and charging;

FIG. 10 is an illustration of a modified corona tube, and

FIG. 11 is a fragmentary sectional elevational view illustrating the manipulation of the corona tube from the outside.

DESCRIPTION OF THE PREFERRED EMBODIMENTS

Figure 1:
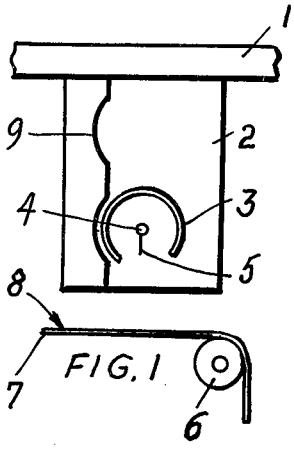
FIGS. 1 to 6 are schematic illustrations showing a corona tube in different positions.

Referring now to the figures where like numerals designate like parts, FIG. 1 shows the cover 1 of the housing of a Corton apparatus, a retainer 2 of a corona, a corona casing or a corona tube 3, a corona electrode 4, the needles 5 of the corona electrode, a guide roller 6 for the paper 7, the photo-conductive semiconductor layer face 8 of the paper, and an arresting device 9 for the height adjustment of the corona tube 3.

The position of the corona tube 3 in FIG. 1 is advantageous for the most intense charging. It may be used for high paper speeds and/or for strong conductive images produced by intense exposure for a contrast formation as distinct as possible. Preferably the corona tube is made of a metal difficult to oxidize.

Figure 2:
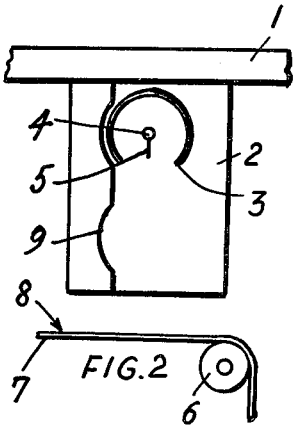

In FIG. 2, the effect of the corona current upon the layer face 8 is weakened with the square of distance for equal electronic data (applied potential). This position is suitable for less intense exposures and as a result thereof weaker conduction images in order to not extinguish them by overcharging and to render them too poor in contrast, respectively. The corona tube 3 with the corona electrode 4 should be mounted in an insulating retainer and should be preferably arrestably adjustable in its spacing from the layer face 8 of the paper.

Figure 3:
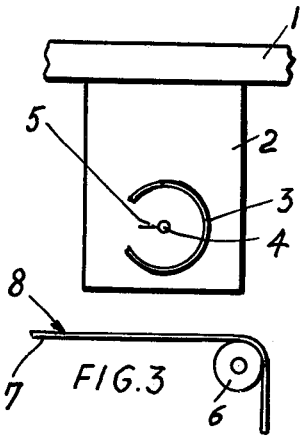

The position of FIG. 3 has a similar effect. Here the corona tube 3 with the corona electrode 4 has been turned to the side with its slit opening. Thereby, the effect of the corona current upon the paper is also reduced and brings about similar advantages as in FIG. 2.

Figure 4:
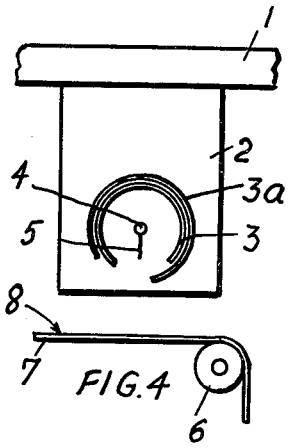

In FIG. 4, the effect of the corona current has been reduced by pushing an aperture plate 3*a* in front of the corona slit opening. More specifically, the casing 3*a* comprises a pair of telescopically arranged first and second tubes, each including a slit opening therein, the first and second tubes being rotatable relative to each other to vary the width of the opening through which the corona discharge is emitted. In this embodiment, the needle direction or scallop direction of a saw tooth of the corona electrode 4 may be turned along or not, different effects thereby resulting.

Figure 5:
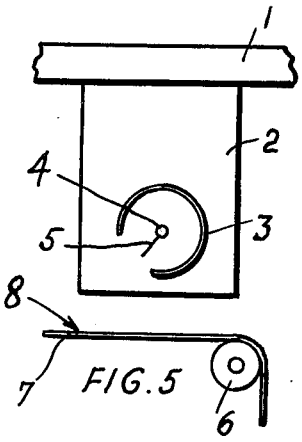
Figure 6:
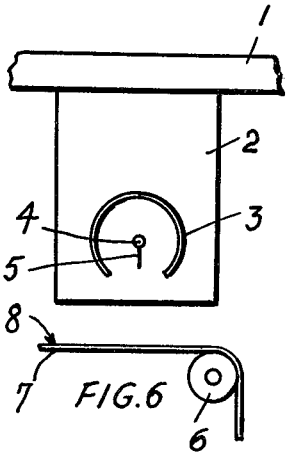

In FIGS. 5 and 6 the spacings between the corona tube edge and the corona electrode tip have been altered. In FIG. 5, as a result of the lesser spacing a higher proportion of the total corona current flows into the corona tube 3, i.e. the effective corona current for the charging of the layer face 8 is reduced—always considering identical electronic data.

A similar effect is achieved by the position of FIG. 6. Here also a greater proportion of the corona current remains in the corona tube.

In FIG. 7, the reference numeral 10 designates the front portion of the light ray oscillograph in which a light ray 11 is projected by suitable measures from a reflecting galvanometer upon the photo-conductive layer face 8.

By displacing the retainer 2 of the corona tube 3 into the position 2', the ratio of the spacings exposure—charging—development is altered. This brings about advantages for some photo-conductive semi-conductor layers regarding contrast.

In FIG. 8 a resistor 12 is arranged between the corona tube 3 and earth (housing), said resistor also being able to be provided variable as potentiometer. By this measure, the corona current may, if required, be amplified towards the photo-conductive layer, and this is convenient for high paper speeds.

In FIG. 9, the number of the effective tips 14 of the electrode is alterable by suitable measures. This brings about the advantage that on the one hand with an increased number a more uniform loading of the layer may be effected and that on the other hand upon reduction of the number of tips the charging on the whole is increased, since a higher voltage is then produced at these tips than at a higher number of tips. The spacing between the needles may range between 1 and 20 mm. Preferably, the needles are made of a metal difficult to oxidize.

FIG. 10 shows a slightly modified corona tube 3 in a more remote spacing from the paper 7 according to FIG. 2. Here, however, the corona tube is connected to a potentiometer 16 via a gear rim or via a rubber roller 15, said potentiometer being controlled accordingly by a rotation of the corona tube. In the position proximate to the paper, a potentiometer 17 of different ratings would have to be employed. These potentiometers vary the primary current of the voltage transformer additionally. A guide 18 for instance ensures that the corona tube is able to be adjusted in height only in a vertical opening position and thereby the initial position of the potentiometer is always identical.

FIG. 11 finally shows the manipulation of the corona tube 3 from the outside with the cover of the Corton apparatus closed. A rotation of a knob 20 corresponds to a rotation of the corona tube 3. An electrically highly insulating material 21 ensures that no current is able to flow between the corona tube 3 and the corona electrode 4, respectively, and the manipulating knob 20.

The invention may be embodied in other specific forms without departing from the spirit or essential characteristics thereof. The embodiments are therefore to be considered in all respects as illustrative and not restrictive.

What is claimed is:

1. An electrophotographic recording device comprising:

(a) means for feeding along a predetermined path paper having a photoconductive semiconductor layer;

(b) means for projecting a light image on said photoconductive semiconductor layer to form a latent image at a first station along said path; and (c) corona discharge means for subjecting said photoconductive semiconductor layer including said latent image to a corona discharge field at a second station downstream of said first station along said path to form a latent charge image;

(d) said corona discharge means comprising a corona electrode, a voltage transformer for supplying current to said corona electrode, a casing enclosing said electrode, said casing comprising a first cylindrical tube having a slit opening in one side thereof for transmitting corona discharge from said electrode to said photoconductive semiconductor layer including said latent image and a second tube telescopically nested over said first tube and including a further slit opening therein, a housing enclosing said casing and electrode, said housing having an opening adjacent said paper for directing said corona discharge from said electrode to said photoconductive semiconductor layer including said latent image, and electrical means and mechanical means for varying the intensity of the corona discharge at the surface of said photoconductive semiconductor layer including said latent image, said mechanical means comprising means to rotate said first and second tubes relative to each other to vary the width of an opening formed by said slits through which said corona discharge is emitted;

(e) whereby the amount of charge applied to the exposed portion of said photoconductive semiconductor layer may be controlled.

2. An electrophotographic recording device according to claim 1 wherein said electrical means for varying the intensity of the corona discharge comprises variable potentiometer means for varying the primary current of said voltage transformer.

3. An electrophotographic recording device according to claim 1 wherein said casing is electrically conductive and said electrical means for varying the intensity of said corona discharge comprises a variable resistance means connecting said casing to an electrical ground.

4. An electrophotographic recording device according to claim 2 wherein said electrical means for varying the intensity of the corona discharge comprises variable potentiometer means for varying the primary current of said voltage transformer.

5. An electrophotographic recording device according to claim 1 wherein said electrode comprises a plurality of metal needles extending in substantially one direction said needles being spaced from 1 to 20 mm from each other.

6. An electrophotographic recording device according to claim 4 wherein said electrode comprises a plurality of metal needles extending in substantially one direction said needles being spaced from 1 to 20 mm from each other.

7. An electrophotographic recording device according to claim 5 wherein said needles are pointed and consist of a metal difficult to oxidize.

8. An electrophotographic recording device according to claim 1 further comprising means for arresting the rotation of at least one of said tubes so that predetermined and reproducible opening widths formed by said slits may be provided.

9. An electrophotographic recording device according to claim 1 wherein said casing consists of a metal difficult to oxidize.

10. An electrophotographic recording device according to claim 1 wherein said mechanical means for varying the intensity of the corona discharge at the surface of said photoconductive semiconductor layer comprises adjustable means for supporting said corona electrode and casing at varying distances from said photoconductive semiconductor layer.

11. An electrophotographic recording device according to claim 6 wherein said mechanical means for varying the intensity of the corona discharge at the surface of said photoconductive semiconductor layer comprises adjustable means for supporting said corona electrode and casing at varying distances from said photoconductive semiconductor layer.

12. An electrophotographic recording device according to claim 10 wherein said adjustable means includes means for arresting the movement of said electrode and casing towards and away from said photoconductive semiconductor layer so that predetermined and reproducible distances between said electrode and said photoconductive semiconductor layer may be obtained.

13. An electrophotographic recording device according to claim 1 wherein said mechanical means for varying the intensity of the corona discharge at the surface of said photoconductive semiconductor layer comprises means rotatably mounting said casing whereby the opening in said casing may be directed towards or away from said photoconductive semiconductor layer.

14. An electrophotographic recording device according to claim 11 wherein said mechanical means for varying the intensity of the corona discharge at the surface of said photoconductive semiconductor layer comprises means rotatably mounting said casing whereby the opening in said casing may be directed towards or away from said photoconductive semiconductor layer.

15. An electrophotographic recording device according to claim 13 wherein said mounting means includes means for arresting the rotation of said casing so that predetermined and reproducible rotational positions may be provided.

16. An electrophotographic recording device according to claim 5 further comprising means for rotatably mounting said electrode such that the space between the tips of said needles and the opening in said casing may be varied.

17. An electrophotographic recording device according to claim 5 wherein said electrode comprises a plurality of elongated elements each having a plurality of metal needles extending transversely therefrom in substantially one direction, at least one of said elements being transversely movable between operative and inoperative positions whereby the number and spacing of the operable needles may be varied.

18. An electrophotographic recording device according to claim 2 further comprising a tachogenerator driven by said means for feeding said paper along said predetermined path, said tachogenerator being operatively connected to said variable potentiometer means to variably control the primary current of said voltage transformer in relation to the speed at which said paper is fed by said feeding means.

19. An electrophotographic recording device according to claim 13 further comprising manual means externally of said device for rotatably adjusting said casing.

20. An electrophotographic recording device according to claim 11 further comprising a plurality of potentiometer means for varying the primary current of said voltage transformer, each said potentiometer means being associated with a selected position of said corona electrode and casing at a predetermined distance from said photoconductive semiconductor layer whereby the intensity of said corona discharge is automatically adjusted depending upon the distance of said corona electrode and casing from said photoconductive semiconductor layer.

* * * * *